United States Patent [19]

Romeo

[11] 4,285,254

[45] Aug. 25, 1981

[54] REVERSIBLE DRIVE RATCHET SOCKET REMOVER ASSEMBLY

[75] Inventor: Richard F. Romeo, Kings Park, N.Y.

[73] Assignee: Excelsior Tool Corp., Jehrico, N.Y.

[21] Appl. No.: 101,048

[22] Filed: Dec. 6, 1979

[51] Int. Cl.[3] ..... B25B 13/00

[52] U.S. Cl. ..... 81/58.1; 81/180 R; 81/184

[58] Field of Search ..... 81/60–63.2, 81/58.1, 177 G, 184, 180 R, 121 R

[56] References Cited

U.S. PATENT DOCUMENTS

| | | | |
|---|---|---|---|
| 3,138,984 | 6/1964 | Penner | 81/177 G |
| 3,691,876 | 9/1972 | Cassidy | 81/58.1 |

*Primary Examiner*—James L. Jones, Jr.

*Attorney, Agent, or Firm*—Blum, Kaplan, Friedman, Silberman & Beran

[57] ABSTRACT

A reversible drive ratchet socket remover assembly adapted to be secured to a conventional reversible drive ratchet wrench for effecting removal of a socket from the wrench. The assembly is adapted to cooperate with a driving stud of a reversible drive ratchet wrench. The assembly includes a disengagement plate cooperatively disposed, with respect to said driving stud, in a first position intermediate a face of the wrench and a socket, when the socket is releasably secured to the driving stud. The disengagement plate is adapted to be displaced from the first position into engagement with the socket to thereby effect removal of the socket from the driving stud.

14 Claims, 7 Drawing Figures

FIG. 3
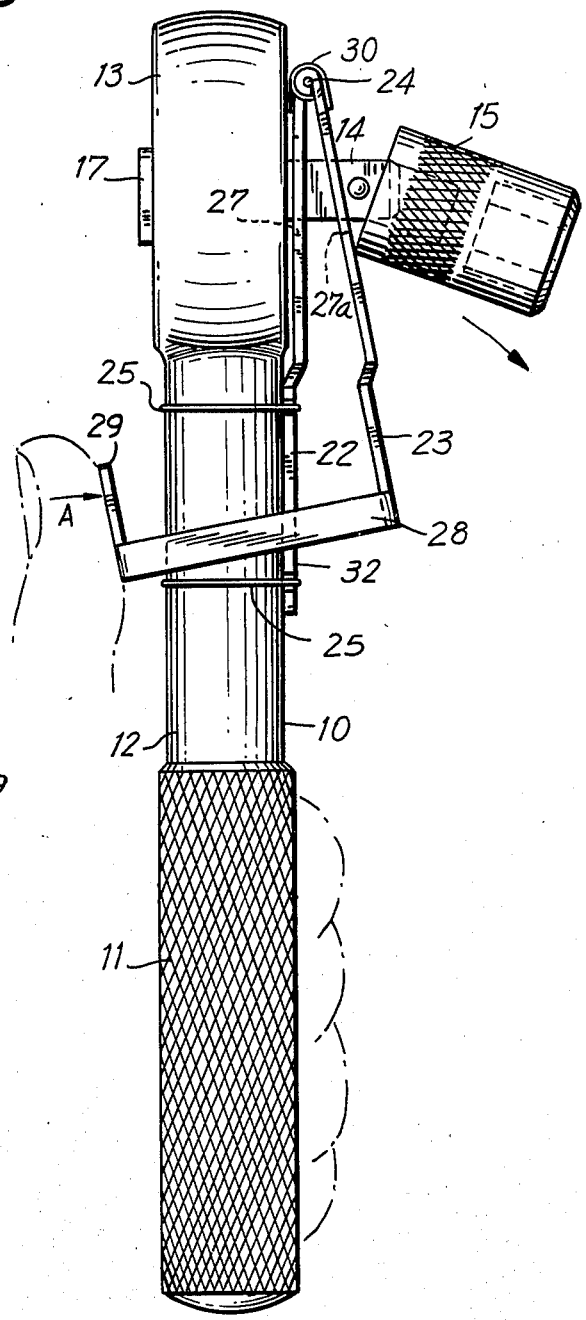
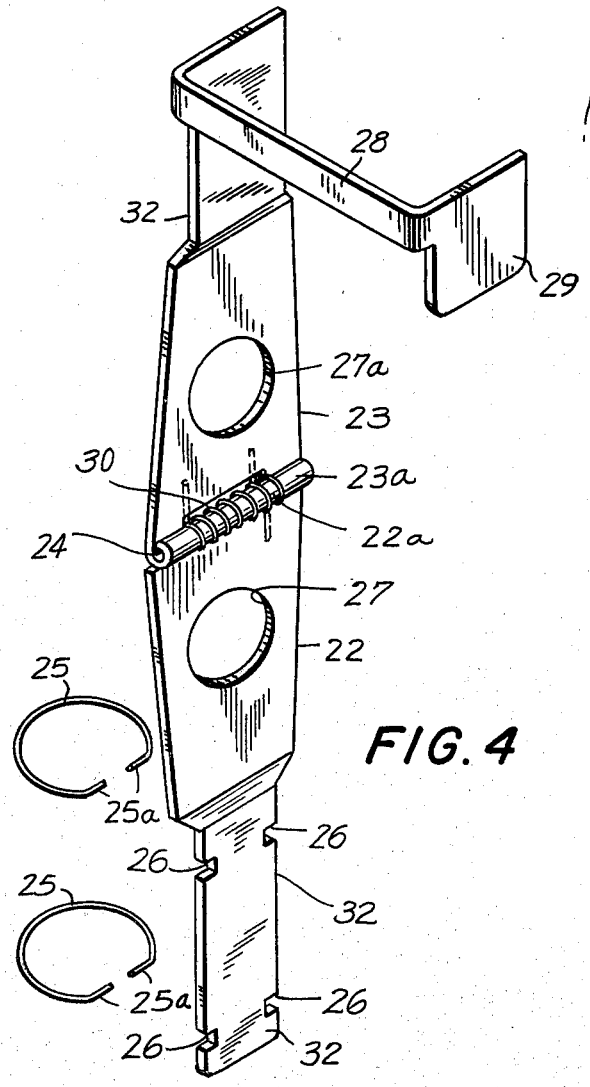
FIG. 4

REVERSIBLE DRIVE RATCHET SOCKET REMOVER ASSEMBLY

BACKGROUND OF THE INVENTION

This invention is directed to a reversible drive ratchet socket remover assembly for use with a conventional reversible drive ratchet wrench and, in particular, to a reversible drive ratchet socket remover assembly adapted to be secured to a conventional reversible drive ratchet wrench for effecting removal of a socket from the wrench.

Conventional reversible drive ratchet wrenches generally include an integrally formed handle and head. The head includes a driving stud that is adapted to receive various dimensioned sockets so that the wrench can be used to loosen or tighten most bolts. The driving stud of the conventional reversible drive ratchet wrench generally includes thereon at least one spring biased ballbearing which frictionally secures a particular socket to the driving stud. However, removal of the socket from the wrench has proven a nuisance in that both of the operator's hands are often required to effect removal of a socket.

U.S. Pat. No. 3,208,318 (Roberts) discloses the use of a manually actuatable detent element as a substitute for the conventional spring biased ballbearing in the driving stud. The detent element is used in conjunction with the driving stud of a socket wrench to allow for quick release of the socket. However, the driving stud is subject to becoming burred or dirty thereby rendering removal of the socket from the stud more difficult. For this reason, use of a detent element of the type illustrated in the Roberts patent has proven less than completely satisfactory in that the operator's hand may be required to effectuate removal of a socket. This has proven to be both cumbersome and burdensome in that generally both of the operator's hands are not available for removal. Accordingly, a reversible drive ratchet socket remover assembly that can be adapted for use with any conventional reversible drive ratchet wrench and permit a plurality of different sized sockets to be freely removed by a single-handed mechanical operation is desired.

SUMMARY OF THE INVENTION

Generally speaking, in accordance with the instant invention, a reversible drive ratchet socket remover assembly, adapted to be secured to any conventional reversible drive ratchet wrench for facilitating removal of a socket therefrom, is provided. The reversible drive ratchet socket remover assembly of the instant invention is adapted to cooperate with a driving stud of the reversible drive ratchet wrench. The assembly includes a disengagement plate cooperatively disposed, with respect to said driving stud, in a first position intermediate a face of the wrench and a socket, when the socket is releasably secured to the driving stud. The disengagement plate is mounted on the wrench for displacement from the first position into engagement with the socket to thereby effect removal of the socket from the driving stud.

In an exemplary embodiment, the disengagement plate can include two pivotally coupled bracket arms. One of the bracket arms is releasably secured to the shaft of the reversible drive ratchet wrench. The other bracket arm is adapted to engage a socket which is releasably secured to the driving stud, when the second bracket arm is pivotally displaced, to thereby effect removal of the socket from the driving stud. A trigger can be coupled to the second bracket arm to thereby effect pivotal displacement thereof.

Accordingly, it is an object of the instant invention to provide a reversible drive ratchet socket remover assembly fully adaptable for use with any conventional reversible drive ratchet wrench.

A further object of the instant invention is to provide a reversible drive ratchet socket removal assembly for facilitating removal of a socket from a reversible drive ratchet wrench.

Another object of the instant invention is to provide a reversible drive ratchet socket remover assembly which provides for one-handed removal of a socket from a reversible drive ratchet wrench.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 3 is a side elevational view of the reversible drive ratchet wrench depicted in FIG. 1, in operation;

FIG. 4 is an exploded perspective view of the reversible drive ratchet socket remover assembly depicted in FIG. 1;

DETAILED DESCRIPTION OF THE PREFERRED EMBODIMENTS

Figure 1:
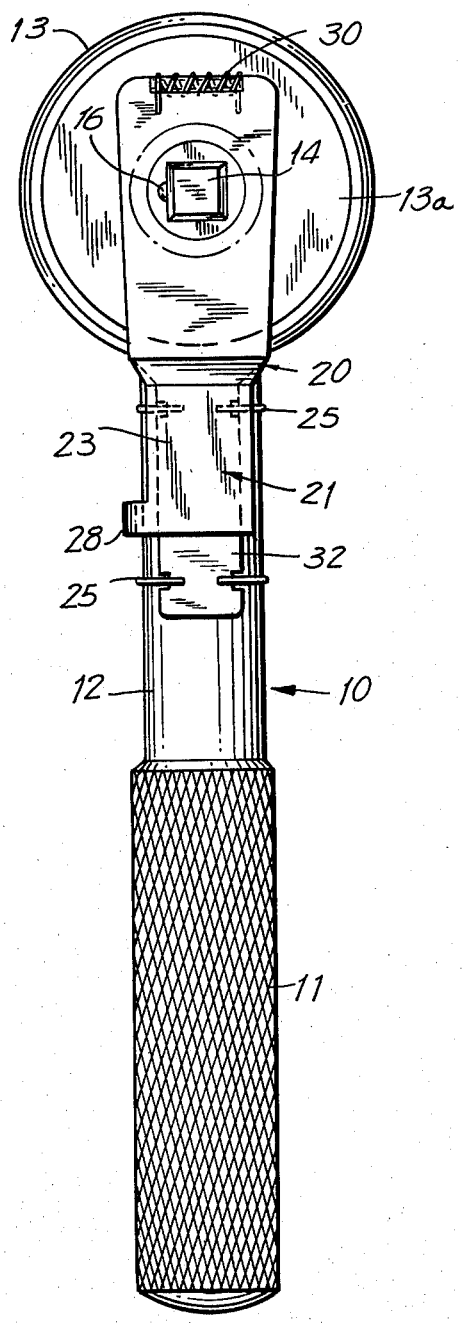
FIG. 1 is an elevational view of a reversible drive ratchet wrench including a reversible drive ratchet socket remover assembly constructed in accordance with a preferred embodiment of the instant invention.
Figure 2:
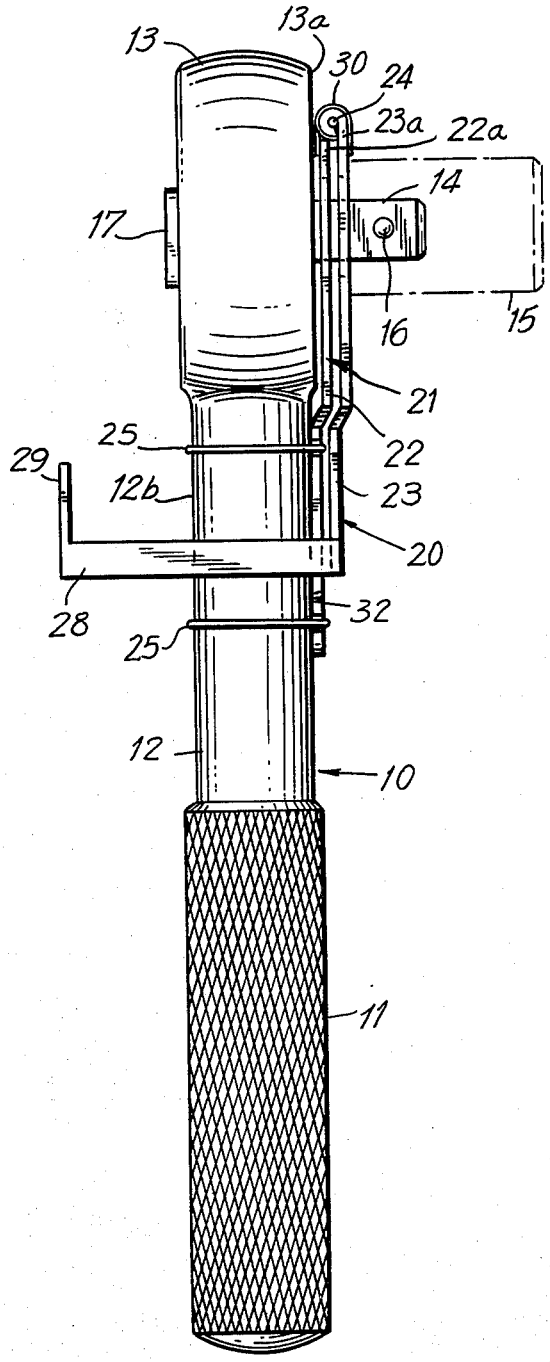
FIG. 2 is a side elevational view of the reversible drive ratchet socket remover assembly depicted in FIG. 1.

Reference is first made to FIGS. 1 and 2, wherein a reversible drive ratchet socket remover assembly, generally indicated as 20, shown secured to a conventional reversible drive ratchet wrench, generally indicated as 10, is depicted. The reversible drive ratchet wrench 10 includes an integrally formed handle 11, a shaft 12 and a head 13. Driving stud 14 is rotatably mounted and positioned on head 13 in a conventional manner and is capable of receiving different sockets dimensioned in either U.S. or metric sizes. Socket 15 is capable of adjusting bolts of a multiplicity of sizes. The socket 15 is generally frictionally retained on the driving stud 14 by means of a spring biased ballbearing 16. It is noted that driving stud 14 can either be fixedly secured to head 13, or alternatively, rotatably secured thereto. Specifically, driving stud 14 can be caused to rotate with the handle in one, but not the opposite, direction by means of a ratchet mechanism, not shown. A control button 17 can be used so as to change the direction of the ratchet drive action.

Referring specifically to FIG. 2, the reversible drive ratchet socket remover assembly includes disengagement plate assembly 21 shown disposed in a first position which allows socket 15, shown in phantom in FIG. 2, to be releasably secured to driving stud 14. Disengagement plate assembly 21 is positioned sufficiently proximate the front surface 13*a* of head 13 to thereby allow socket 15 to be properly engaged to driving stud 14 by ballbearing 16.

Referring now to FIGS. 2 and 4, it is noted that disengagement plate assembly 21 includes a stationary bracket arm 22 and a pivotable bracket arm 23. Stationary bracket arm 22 is adapted to be releasably mounted to shaft 12 of reversible drive ratchet wrench 10 by clips 25. Specifically, stationary bracket arm 22 includes a flange 32 having notches 26 therein for receiving fastening ends 25*a* of each clip 25.

Pivotable bracket arm 23 is pivotally coupled at a first end 23*a* to a first end 22*a* of stationary bracket arm 22 by an axle 24 to define a pivotal coupling. The pivotal coupling is disposed adjacent head 13 and proximate to driving stud 14. Stationary bracket arm 22 and pivotable bracket arm 23 include apertures 27 and 27*a*, respectively, which apertures are disposed in alignment with respect to each other when bracket arms 22 and 23 are in the position illustrated in FIG. 2, for allowing driving stud 14 to project therethrough. Apertures 27 and 27*a* are included in stationary bracket arm 22 and pivotable bracket arm 23 so that the respective bracket arms can remain in a first position intermediate the front surface 13*a* of wrench head 13 and a socket 15, when the socket is releasably secured to the driving stud 14. Pivotable bracket arm 23 includes a trigger 28. Trigger 28 extends beyond the rear surface 12*b* of shaft 12 and includes thereon extension 29 for allowing trigger 28 to be finger actuated.

As is illustrated with particularity in FIG. 4, a biasing coil spring 30 is joined to the respective first ends of bracket arms 23 and 22, and axle 24 at the position that the respective bracket arms are pivotally coupled together. Biasing spring 30 insures that bracket arm 23 is normally biased against bracket arm 22, and hence, is in a first position intermediate the socket and the front surface of the wrench head when the socket is releasably secured to the driving stud. It is further noted that both arms of the disengagement plate assembly include flange portions 32 for allowing the respective arms to remain adjacent head 13 when movable arm 23 is in position, as illustrated in FIG. 2

Accordingly, operation of the reversible drive ratchet socket remover assembly of the instant invention will be explained in accordance with FIGS. 2 and 3. As illustrated in FIG. 2, disengagement plate assembly 21 and, hence, stationary bracket arm 22 and pivoting bracket arm 23 remain in the first position proximate head 13 due to the biasing action of coil spring 30.

In FIG. 3 the ejection of socket 15 from the driving stud is depicted. When the operator of the socket wrench applies a force, in the direction indicated by arrow A, to the extension 29 of trigger 28, pivoting bracket arm 23 is pivoted about axle 24. When the pivoting bracket arm 23 pivots about axle 24, socket 15 is urged off of driving stud 14. It is noted that aperture 27*a*, in pivoting bracket arm 23, is dimensioned so as to allow free movement of pivoting bracket arm 23 without interfering with driving stud 14.

The removal of socket 15 having been effected by the pivotal displacement of pivotable bracket arm 23, the operator can release trigger 28 and the compression in coil spring 30 will return the pivotable bracket arm 23 to its first position and permit driving stud 14 to receive a new socket thereon.

It is noted that the reversible drive ratchet socket remover assembly of the instant invention, described above, can be integrally secured to a reversible drive ratchet wrench or socket wrench and the combination can be sold as a complete unit instead of merely selling the instant invention as an attachment for a reversible drive ratchet wrench. Moreover, the reversible drive ratchet socket remover assembly of the instant invention is not limited to utilizing mounting clips of the type described above to secure same to a socket wrench. Instead, aligned threaded apertures can be provided in the wrench and the non-pivotable bracket arm so that the bracket arm can be releasably secured to the wrench by inserting screws into the aligned threaded apertures.

Figure 5:
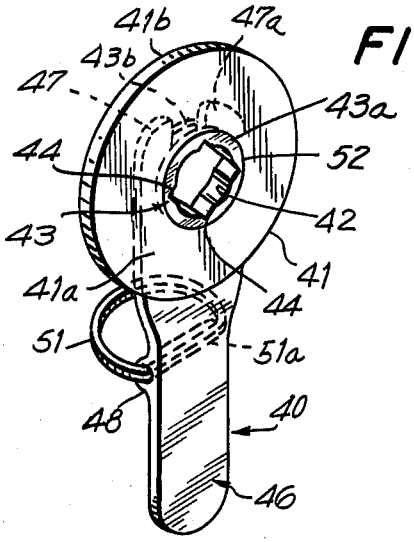
FIG. 5 is a perspective view of a reversible drive ratchet socket remover assembly constructed in accordance with a further embodiment of the instant invention.
Figure 6:
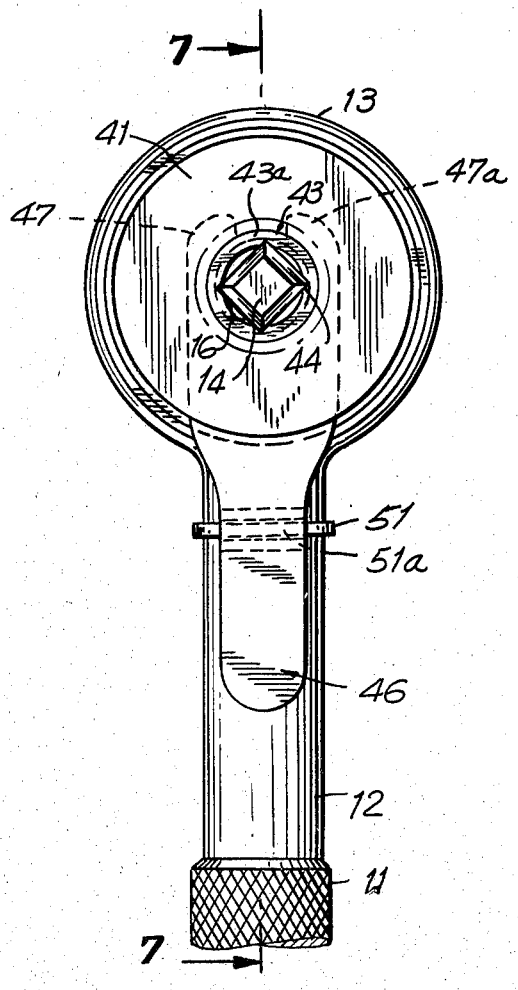
FIG. 6 is an elevational view of a reversible drive ratchet wrench including the reversible drive ratchet socket remover assembly depicted in FIG. 5.
Figure 7:
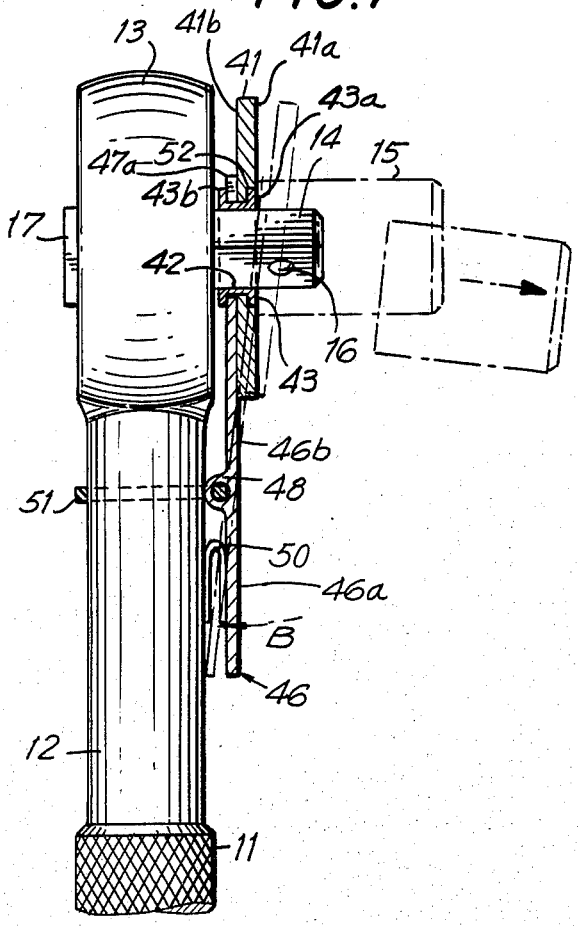
FIG. 7 is a side elevational view of the reversible drive ratchet wrench depicted in FIG. 6, in operation.

Reference is now made to FIGS. 5 through 7, wherein a reversible drive ratchet socket remover assembly, particularly suited for use with a drive ratchet spinner, generally indicated as 40, constructed in accordance with a further embodiment of the instant invention, is illustrated. Where appropriate, like reference numerals are utilized to denote like elements depicted in the embodiment illustrated in FIGS. 1 through 4.

For use in tight quarters, or to start rotation of a bolt or the like by a reversible drive ratchet wrench, a ratchet drive spinner 41 has been provided. Ratchet drive spinner 41 includes inner wall 42 defining an aperture therein for allowing driving stud 14 to project therethrough. A rim 43 is fixedly secured to inner wall 42 so as to be rotatable with ratchet drive spinner 41. Ratchet drive spinner 41 includes a recess 52 for receiving the front lip 43*a* of rim 43 to thereby allow rim 43 to remain flush with the front face 41*a* of the ratchet drive spinner 41. Rim 43 includes thereon notches 44. Notches 44 cooperatively engage driving stud 14 when ratchet drive spinner 41 is disposed on the stud to thereby rotate driving stud 14 when ratchet drive spinner 41 is rotated.

Rim 43 extends beyond the rear surface 41*b* of ratchet drive spinner 41 to allow disengagement plate 46 to be coupled thereto. Specifically, fingers 47 and 47*a* of disengagement plate 46 extend between the rear surface 41*b* of ratchet drive spinner 41 and the back lip 43*b* of rim 43 to allow ratchet drive spinner 41 to rotate freely with respect to disengagement plate 46 and to allow disengagement plate 46 to be coupled thereto.

Disengagement plate 46 includes a fulcrum 48 secured thereto. Fulcrum 48 is utilized as a pivoting point for disengagement plate 46 and as a mounting in conjunction with clip 51 to secure disengagement plate 46 to shaft 12 of the reversible drive ratchet wrench. Fulcrum 48 defines an elongated thoughole therein for receiving fastening end 51*a* of clip 51. A leaf spring 50 is mounted to the disengagement plate 46 by welding or by a suitable bonding agent and positioned intermediate shaft 12 and the portion 46*a* of disengagement plate 46 below fulcrum 48 to normally bias portion 46*b* of disengagement plate 46 above fulcrum 48 and, hence, ratchet drive spinner 41 coupled thereto, in a first position intermediate a socket and the front surface of the wrench head when the socket is releasably secured to the driving stud.

Accordingly, operation of the embodiment illustrated in FIGS. 5 through 7 is as follows. Portion 46*b* of disengagement plate 46 and the ratchet drive spinner 41 coupled thereto remain in the first position proximate head 13 due to the biasing action of leaf spring 50. When the operator of the socket wrench applies a force, in the direction indicated by arrow B, to portion 46*a* of disengagement plate 46, disengagement plate 46 is pivoted about fulcrum 48. When disengagement plate 46 pivots about fulcrum 48, portion 46*b* of disengagement plate 46 is pivoted away from head 13 thereby urging socket 15 off of driving stud 14.

Removal of socket 15 having been effected by the pivotal displacement of disengagement plate 46, the operator can release portion 46*a* of disengagement plate 46 and the compression in leaf spring 50 will return portion 46*b* of disengagement plate 46 as well as ratchet drive spinner 41 coupled thereto, to the first position and permit driving stud 14 to receive a new socket thereon.

The instant invention is particularly characterized by a reversible drive ratchet socket remover assembly that can be secured to any conventional reversible drive ratchet wrench to thereby convert same into a wrench which allows a socket, releasably secured to the driving stud of the socket wrench, to be mechanically released by the movement of the same hand that is holding the wrench. It is noted that the instant invention facilitates removal of a socket from a ratchet wrench regardless of the position of the wrench.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A reversible drive ratchet socket remover, adapted to be attached to a reversible drive ratchet wrench and cooperate with a driving stud of said reversible drive ratchet wrench, comprising a disengagement plate means cooperatively disposed in a first position and intermediate said wrench and a socket, when said socket is releasably secured to said stud, a ratchet drive spinner operatively coupled to said disengagement plate means so that said ratchet drive spinner is cooperatively disposed on said driving stud in rotating engagement therewith, said ratchet drive spinner being disposed in said first position by said disengagement plate means when said socket is releasably secured to said stud, said disengagement plate means including mounting means for releasably mounting said disengagement plate means to a reversible drive ratchet wrench and for permitting said disengagement plate means and said ratchet drive spinner to be displaced from said first position into engagement with said socket when said socket is releasably secured to said stud to thereby effect removal of said socket from said stud.

2. A reversible drive ratchet socket remover adapted to be attached to a reversible drive ratchet wrench and cooperate with a driving stud of said reversible drive ratchet wrench, comprising a disengagement plate means cooperatively disposed in a first position and intermediate said wrench and a socket, when said socket is releasably secured to said stud, said disengagement plate means including mounting means for releasably mounting said disengagement plate means to a reversible drive ratchet wrench and for permitting said disengagement plate means to be displaced from said first position into engagement with said socket when said socket is releasably secured to said stud to thereby effect removal of said socket from said stud, said mounting means being a stationary bracket arm, said disengagement plate means including a pivotable bracket arm pivotally coupled to said stationary bracket arm, said pivotable bracket arm being disposed in said first position when said socket is releasably secured to said driving stud and is pivotably displaceable from said first position into engagement with said socket when said socket is releasably secured to said stud, to thereby effect removal of said socket from said stud.

3. A reversible drive ratchet socket remover, as claimed in claim 2, and including securing means for releasably mounting said stationary bracket arm to said reversible drive ratchet wrench.

4. A reversible drive ratchet socket remover assembly, as claimed in claim 1, and including spring means coupled to said disengagement plate means for normally biasing said disengagement plate means into said first position so that said spring means returns and substantially maintains said disengagement plate means into said first position after removal of a socket has been effected thereby.

5. A reversible drive ratchet socket remover assembly, as claimed in claim 2, 3 or 4, wherein said disengagement plate means includes a trigger for effecting displacement of said disengagement plate means from said first position into engagement with said socket when said socket is releasably secured to said stud.

6. A reversible drive ratchet socket remover assembly, as claimed in claim 3, wherein said stationary bracket arm and said pivotable bracket arm include aligned apertures therein, said driving stud adapted to extend through and out of contact with said apertures when said stationary bracket arm and pivotable bracket arm are in at least said first position.

7. A reversible drive ratchet socket remover assembly, as claimed in claim 6, and including an axle for supporting a first end of said stationary bracket arm and a first end of said pivotable bracket arm to define a pivotal coupling therebetween.

8. A reversible drive ratchet socket remover assembly, as claimed in claim 7, wherein said spring means is coupled about said axle for normally biasing said pivotable bracket arm into said first position.

9. A reversible drive ratchet socket remover assembly, as claimed in claim 1 or 4, wherein said mounting means is a fulcrum secured to said disengagement plate means for permitting said disengagement plate means to pivot about said fulcrum from said first position into engagement with said socket, when said socket is releasably secured to said stud, to thereby effect removal of said socket from said stud.

10. A reversible drive ratchet socket remover assembly, as claimed in claim 9, and including securing means for releasably mounting said fulcrum to said reversible drive ratchet wrench to thereby allow said disengagement plate means to pivot about said fulcrum.

11. A reversible drive ratchet socket remover assembly, as claimed in claim 1, wherein said mounting means is a fulcrum secured to said disengagement plate means for permitting said disengagement plate means to pivot about said fulcrum, said ratchet drive spinner in response to the pivotal displacement of said disengement plate means being displaceable from said first position into engagement with said socket when said socket is releasably secured to said stud to thereby effect removal of said socket from said stud.

12. A reversible drive ratchet socket remover assembly, as claimed in claim 11, wherein said ratchet drive spinner includes coupling means for coupling said disengagement plate means to said ratchet drive spinner for allowing displacement therewith.

13. A reversible drive ratchet socket remover assembly, as claimed in claim 12, wherein said ratchet drive spinner includes an aperture therein and said coupling means is a rim fixedly secured in the aperture of said ratchet drive spinner, said rim being adapted to rotatingly engage said driving stud, said rim including a lip for coupling said disengagement plate means thereto.

14. A reversible drive ratchet socket remover assembly, as claimed in claim 12, wherein said spring means is a leaf spring secured to said disengagement plate means and disposed intermediate said disengagement plate means and said reversible drive ratchet wrench.

* * * * *